United States Patent [19]

Winders et al.

[11] 4,334,371

[45] Jun. 15, 1982

[54] UNITARY HANDLE AND DISPLAY TAG

[75] Inventors: Gordon R. Winders; Fredric M. MacKay, both of Raleigh, N.C.

[73] Assignee: Rheem Manufacturing Company, New York, N.Y.

[21] Appl. No.: 130,037

[22] Filed: Mar. 13, 1980

[51] Int. Cl.[3] ..... G09F 3/16

[52] U.S. Cl. ..... 40/2 R; 40/11 R

[58] Field of Search ..... 40/2 R, 2 F, 11 R, 11 A, 40/305, 21 R

[56] References Cited

U.S. PATENT DOCUMENTS 2,204,149 6/1940 Pratt ..... 40/305

4,182,474 1/1980 Sato ..... 40/2 R X

FOREIGN PATENT DOCUMENTS 339227 7/1921 Fed. Rep. of Germany ..... 40/2 R 1474152 2/1967 France ..... 40/11 R

*Primary Examiner*—John F. Pitrelli

*Attorney, Agent, or Firm*—Allegretti, Newitt, Witcoff & McAndrews

[57] ABSTRACT

A molded plastic display tag includes a display panel with a rib along the bottom edge of the panel. A tapered stem with a knob formed on its distal end projects from the midpoint of the rib. The stem is tapered for cooperation with a metal clip which may be fastened about the stem and packaging material. The panel and rib are sized and shaped to permit manual gripping.

5 Claims, 4 Drawing Figures

UNITARY HANDLE AND DISPLAY TAG

BACKGROUND OF THE INVENTION

In a principal aspect, the present invention relates to an improved display tag especially adapted for cooperation with a metal packaging clip.

Poultry and other packaged meats and foods are often retained in a plastic or cellulose wrapping or casing which is fastened at one or both ends by a metal clip. Typically, the food product is placed in a casing. The open end of the casing is then gathered and a metal clip is affixed about the gathered end.

Because such products are often bulky and have an unsymmetrical shape, it is desirable to provide a handle or loop attached to the package so that the product can be hung for display or manually carried by a customer with greater ease. Tipper et al., in U.S. Pat. No. 3,499,259, discloses one method for forming the end of the casing material in a loop for such a package. The casing material is gathered and a free end of the material is formed in a loop. The loop is retained by the metal packing clip.

The structure and arrangement for making a carrying handle as disclosed in U.S. Pat. No. 3,499,259 provides a good solution to the need. Some disadvantages have, however, been noted. For example, the extra packaging material, which may be expensive, needed to form the loop is, in effect, wasted packaging material. Also, the end of the packaging material may slip through the metal clip due to the weight of the product when the product is being carried by the formed loop.

As an alternative to the arrangement shown in U.S. Pat. No. 3,499,259, it has been suggested that a separate display tag and product carrying handle be attached when the package clip is attached to product casing. This suggestion resulted in the development of a handle and display tag as described and claimed herein.

SUMMARY OF THE INVENTION

Briefly, the present invention comprises an improved display tag which is adapted to be attached by a metal clip to a packaged product. The tag also serves as a handle for carrying the product. The tag is comprised of a flat planar display panel with a rib that defines one straight edge of the panel and serves as the portion of the tag which is manually gripped as a handle. A stem projects from the rib. The stem is specially formed with converging sides so that the stem may be attached by a clip to the packaged material and snugly retained by that clip even when the display tag is utilized as a handle for carrying the packaged material. The outer end of the stem has a knob form to further insure retention of the tag by a clip. A series of tags may be molded in a continuous ribbon.

It is thus an object of the present invention to provide an improved handle and display tag adaptable for attachment by metal clip to a packaged product.

It is a further object of the present invention to provide an improved display tag which simultaneously functions as a handle for a packaged product.

Still a further object of the present invention is to provide a display tag which is easily manufactured as a unitary, molded plastic product.

One further object of the present invention is to provide an improved product display tag which includes a tapered stem for cooperation with a metal clip attachment to thereby enhance the attachment of the display tag to a package.

A further object is to provide a display tag which may be formed as part of a ribbon of connected display tags.

These and other objects, advantages and features of the invention will be set forth in the detailed description which follows.

BRIEF DESCRIPTION OF THE DRAWING

In the detailed description, reference will be made to the drawing comprised of the following figures.

DESCRIPTION OF THE PREFERRED EMBODIMENT

The improved display tag and handle of the present invention is normally molded preferably by an injection molding process from a plastic or nylon material. As shown in the figures, the tag includes a generally rectangular panel 10 which projects from a rib 12. A stem 14 also projects from the rib 12 in a direction opposite the panel 10. The stem 14 is arranged generally at the midpoint of the rib 12.

Figure 1:
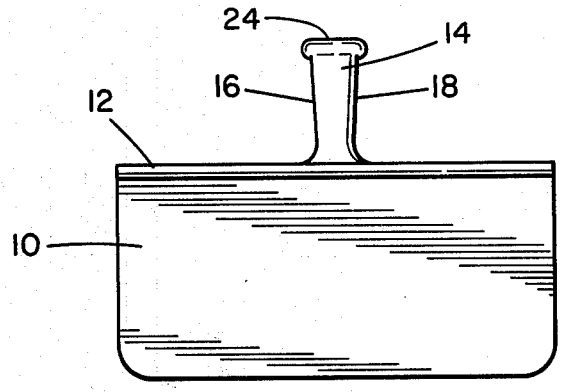
FIG. 1 is a front elevation of the improved display tag and handle of the present invention.
Figure 2:
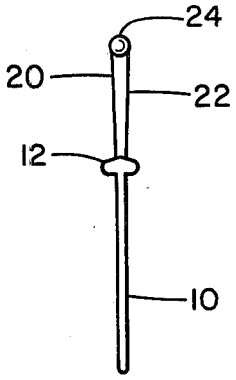
FIG. 2 is a side elevation of the improved display tag and handle of the present invention.

The rib 12 is dimensioned to maintain the stability of the tag. The length of the rib 12 in actual practice is approximately three inches. The width as shown in FIG. 2 is approximately one quarter ($\frac{1}{4}$) inch and the thickness of the rib 12 is approximately three sixteenths (3/16) of an inch. Thus, the panel 10 of the tag constitutes a display area of approximately three (3) inches by one and three eighths ($1\frac{3}{8}$) inches. The stem 14 projects approximately three quarters ($\frac{1}{4}$) of an inch from the rib 12. The stem 14 includes oppositely converging sides 16 and 18 and converging front and rear sides 20, 22 respectively as shown in FIG. 2. The free end of the stem 14 defines a knob 24.

Figure 3:
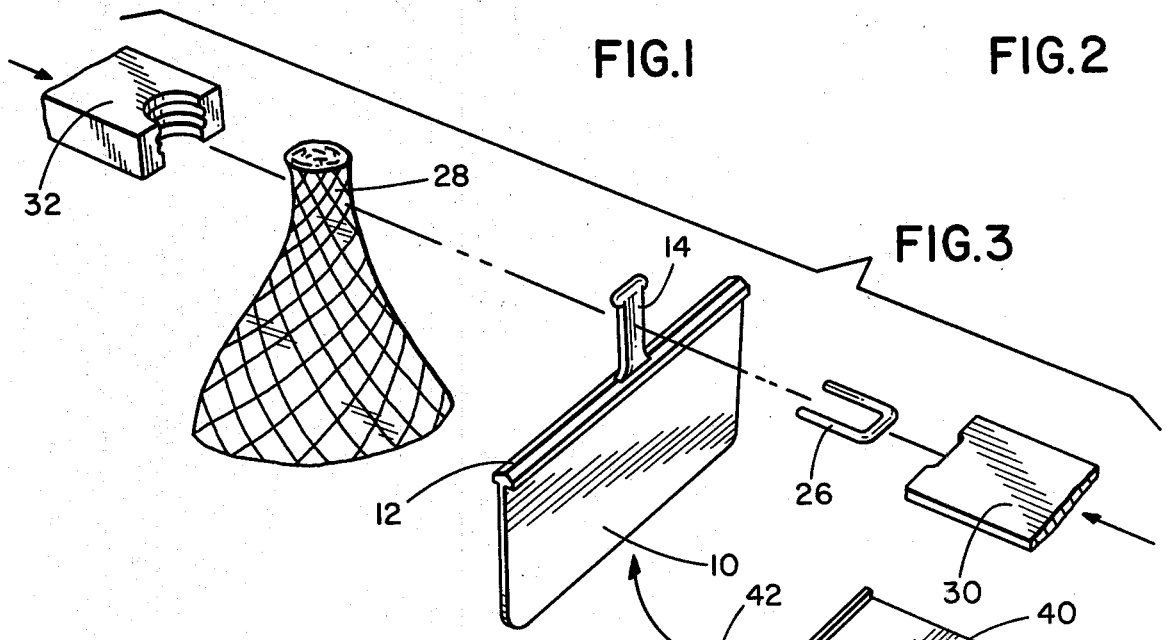
FIG. 3 is an exploded perspective view of the display tag and handle prior to attachment to a package or bag.
Figure 4:
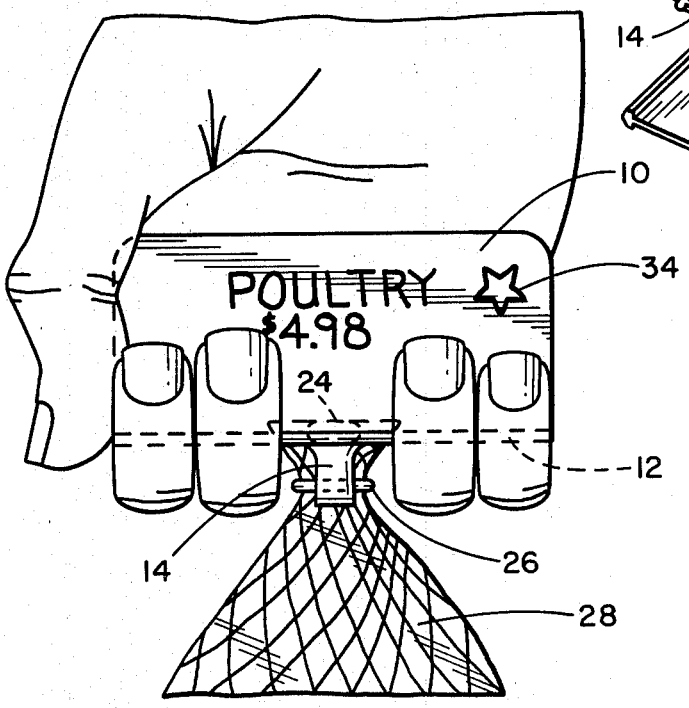
FIG. 4 is a perspective view of the improved display tag and handle of the present invention as affixed to a package.

FIGS. 3 and 4 illustrate the manner in which the display tag of the present invention is utilized. As shown in FIG. 3, the stem 14 is configured to cooperate with a metal clip 26 which fastens about the stem 14 and a gathered end 28 of packaging material or casing. The casing contains a food product such as poultry or the like. The clip 26 is affixed about the stem 14 and package end 28 by means of a cooperative punch 30 and die 32 schematically illustrated in FIG. 3. The prior art Tipper et al patent referenced above discloses a similar clipping device.

When the clip 26 is affixed to the bag end 28 as shown in FIG. 4, it is possible to manually grasp the tag in the manner illustrated. The rib 12 is engaged by fingers of a hand as shown. Note that the rib 12 has sufficient rigidity to prevent flexing of the tag and to permit the tag to serve as a handle. The panel 10 serves as a display area on which indicia 34 may be imprinted for display of the food product. Because the stem 14 is shaped with the described tapers, it has been found that the display tag will not slip from the grip of the metal clip 26. The knob 24 also serves to prevent removal of the stem 14 from a clip 26. The weight of the package supported by the tag accentuates the frictional hold of a clip 26 to the stem 14.

As shown in FIG. 3, a plurality of tags 40 may be molded in a continuous ribbon with a stem 14 of one tag 40 connected by a link 42 with the panel of the adjacent tag 40. When tags 40 are arranged in a ribbon, the knob 24 and stem 12 may be inserted in guide channels for feeding into a clipper machine. Thus, the tags 40 may be formed in a roll which is fed into a clipper machine.

Various modifications to the structure as described are possible. It is for this reason that the invention is to be limited only by the following claims and their equivalents.

What is claimed is:

1. An improved display tag and handle for attachment by a metal clip to a casing or bagged product, said tag comprising in combination:

a flat planar flexible display panel having at least one straight edge, a rib defining said straight edge, said panel projecting from one side of the rib; and a stem projecting from the other side of the rib in the opposite direction from the panel, said stem being adapted to be clipped by a clip which is used to close the casing, said stem defining a plurality of surfaces which gradually converge from the distal free end of the stem toward the rib whereby the stem tends to become tightly wedged in the clip as the tag is pulled in the direction of the rib and panel;

said rib is a generally inflexible rigid bar member and extends on opposite sides of the stem a sufficient distance to permit manual gripping of the rib on each side of the stem, for use as a handle, said stem is defined by a width dimension and a thickness dimension transverse to the stem and a length dimension generally perpendicular to the rib, said width dimension and said thickness dimension decreasing from a maximum adjacent the end of the stem to a minimum adjacent the connection of the stem to the rib, and a molded knob at the distal end of the stem.

2. The tag of claim 1 wherein said panel is generally rectangular with the rib defining one side of the rectangle.

3. The tag of claim 1 wherein said stem projects from the midsection of the rib.

4. The tag of claim 1 wherein said tag is fabricated as a single molded plastic article of manufacture.

5. The tag of claim 1 in combination with a plurality of tags formed in a ribbon with the stem of each consecutive tag connected with the panel of the adjacent tag.

* * * * *